United States Patent [19]

Shimomoto et al.

[11] Patent Number: 4,900,975

[45] Date of Patent: Feb. 13, 1990

[54] TARGET OF IMAGE PICKUP TUBE HAVING AN AMORPHOUS SEMICONDUCTOR LAMINATE

[75] Inventors: Yasuharu Shimomoto, Hamamatsu, Japan; Sachio Ishioka, Burlingame, Calif.; Yukio Takasaki, Kawasaki; Tadaaki Hirai, Koganei; Kazutaka Tsuji, Hachioji; Tatsuo Makishima, Mitaka; Hirokazu Matsubara, Tokyo; Kenji Sameshima, Hachioji; Junichi Yamazaki, Kawasaki; Kenkichi Tanioka; Mitsuo Kosugi, both of Tokyo; Keiichi Shidara; Tatsuro Kawamura, both of Tama; Eikyuu Hiruma, Komae; Takashi Yamashita, Sagamihara, all of Japan

[73] Assignees: Hitachi, Ltd.; Nippon Hoso Kyokai, both of Tokyo, Japan

[21] Appl. No.: 67,229

[22] Filed: Jun. 29, 1987

[30] Foreign Application Priority Data

Jun. 27, 1986 [JP] Japan ..... 61-149553

[51] Int. Cl.[4] ..... H01J 29/45; H01J 31/38

[52] U.S. Cl. ..... 313/366; 313/386

[58] Field of Search ..... 313/365, 366, 384, 385, 313/386

[56] References Cited

U.S. PATENT DOCUMENTS 3,984,722 10/1976 Maruyama et al. ..... 313/386

4,419,604 12/1983 Ishioka et al. ..... 313/386 X

*Primary Examiner*—Kenneth Wieder

*Attorney, Agent, or Firm*—Antonelli, Terry & Wands

[57] ABSTRACT

A target of an image pickup tube is formed by laminating at least a transparent conductive film, an amorphous layer consisting essentially of silicon, and an amorphous layer consisting essentially of selenium in the above order on a light-transmitting substrate.

12 Claims, 2 Drawing Sheets

TARGET OF IMAGE PICKUP TUBE HAVING AN AMORPHOUS SEMICONDUCTOR LAMINATE

RELATED APPLICATIONS

This application relates to a U.S. Application Ser. No. 069,156, filed July 2, 1987 based on Japanese Patent Application No. 61-156317 filed July 4, 1986.

BACKGROUND OF THE INVENTION

1. Field of the Invention

This invention relates to a photoelectronic conversion element using an amorphous semiconductor material, and more particularly to a target of an image pickup tube having a photoelectronic conversion part suitable for use as an imaging device used in a television camera or the like.

2. Description of the Prior Art

Amorphous silicon containing hydrogen (referred to hereinafter as "a-Si: H") has a high photoelectronic conversion efficiency and converts almost all of absorbed light into an electrical signal. It is an advantage of this a-Si: H that it can be doped with an impurity as in the case of crystalline semiconductors. It is another advantage of the a-Si: H that its film can be deposited at a low temperature on various substrates. Various devices making use of such advantages of the a-Si: H have been proposed hitherto. As a typical example of an imaging device using this a-Si: H, Japanese Patent Publication JP-B-57-046224 (1982) discloses an image pickup tube in which the a-Si: H is used to form a photoelectronic conversion film. The disclosed image pickup tube has various excellent features as follows: (1) the sensitivity for visible light is high; (2) the resolution is high; (3) it operates with a low lag and no sticking or no after image occurs after picking-up of still pictures for long period of time; and (4) it shows a high thermal stability.

However, the inventors found that, when a prior art image pickup tube using the a-Si: H was operated under acceleration of its scanning electron beam at a high voltage higher than about 700 to 1,000 volts, its operating characteristics changed, that is, its sensitivity was lowered, the dark current increased, etc.

The inventors considered that such a phenomenon might be similar to a phenomenon of lowering of the photoelectronic conversion efficiency attributable to irradiation with strong light, such as that also observed on a solar cell using the a-Si: H, and directed attention to soft X-rays generated due to collision of the scanning electron beam against the mesh-type accelerating electrode in the image pickup tube. Then, the inventors invented a method of suppressing progress of changes in the operating characteristics of such a tube by covering the surface of a mesh electrode with a material such as carbon or beryllium, as disclosed in JP-A-59-96639.

However, because no contrivence was applied to the a-Si: H photoconductive layer itself, in addition to the limitation of using a special mesh structure, the operating characteristics of the image pickup tube inevitably changed when the tube was incorporated in, for example, a monitoring camera continuously used for a very long period of time.

SUMMARY OF THE INVENTION

It is an object of the present invention to provide an imaging device in which the prior art problem is obviated without sacrificing the excellent features of an a-Si: H photoconductive film and which operates with stable operating characteristics.

The above object is attained by forming a photoelectronic conversion part by laminating a layer of a-Si: H and a layer of an amorphous chalcogenide consisting essentially of selenium. In this laminate, it is essential to dispose the a-Si: H layer on the light receiving side of the photoelectronic conversion part.

The a-Si: H has a high light absorption coefficient, and its optical bandgap can be suitably adjusted by controlling the condition of film formation and the content of hydrogen. Therefore, a thin film of a-Si: H can efficiently absorb signal light. For example, an a-Si: H film having a thickness of only about 0.5 $\mu$m can sufficiently deal with signal light having wavelengths belonging to a visible wavelength range when the optical bandgap of the a-Si: H is selected to be about 1.7 eV. Further, since the photoelectronic conversion efficiency of the a-Si: H is high, the a-Si: H can absorb almost all of an incident optical signal and efficiently convert the optical input into photocarriers.

On the other hand, when compared with the a-Si: H, amorphous selenium has a higher $\mu\tau$ (mobility lifetime) product of holes, has a smaller electrical susceptibility and has a higher dark conductivity. Further, although the amorphous selenium absorbs soft X-rays and other radiant rays, it is hardly damaged by those rays, and its film can be formed by deposition at low temperatures. Therefore, a film of the amorphous selenium can be deposited on a layer of the a-Si: H without any possibility of damaging the underlying a-Si: H layer.

For the reasons described above, when a photo-electronic conversion part of multilayered structure in which its light receiving side is formed of a thin film consisting essentially of a-Si: H, and its side scanned with an electron beam to read an optical input signal is formed of a film consisting essentially of amorphous selenium, is used as a target of an image pickup tube, such a target possesses the features of both of these materials and can operate with excellent operating characteristics which have not been exhibited hitherto.

DESCRIPTION OF THE PREFERRED EMBODIMENTS

Figure 1:
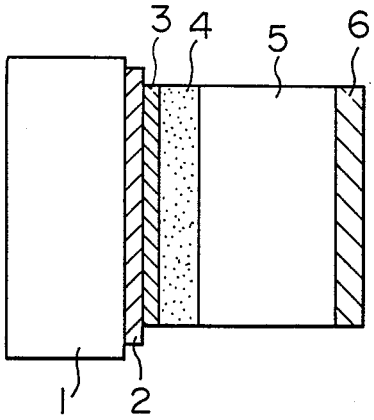
FIG. 1 is a schematic sectional view of an embodiment of the photoelectronic conversion part of the image pickup tube according to the present invention.

FIG. 1 is a schematic sectional view of a photoelectronic conversion part of an image pickup tube embodying the present invention. Referring to FIG. 1, the photoelectronic conversion part comprises a flat transparent glass substrate 1, a transparent electrode 2, a hole blocking layer 3, a photoconductive film 4 of a-Si: H, a layer 5 of an amorphous chalcogenide consisting essentially of selenium, and a layer 6 having a function of ensuring smooth landing of an electron beam. The transparent electrode 2 is preferably a very thin film of an oxide such as tin oxide or indium-tin oxide or a very thin light-transmitting film of an evaporated metal. The hole blocking layer 3 acts to block flow of holes from the transparent electrode 2 toward and into the photoconductive film 4 thereby suppressing the dark current to a low level and acts also to improve the photoresponse. In addition to the function of ensuring smooth landing of an electron beam, the layer 6 acts also to block injection of scanning electrons toward and into the amorphous chalcogenide layer 5 consisting essentially of amorphous selenium. Commonly, a porous layer of a material such as antimony trisulfide is used as this layer 6.

The hole blocking layer 3 blocking flow of holes toward and into the photoconductive film 4 of a-Si: H is preferably a very thin film of a-Si: H doped with a donor impurity such as phosphorus, a material such as amorphous silicon nitride showing a high potential barrier against holes, or an electrical insulator such as silicon oxide. The thickness of the layer 3 is about 100 Å.

The thickness of the photoconductive layer 4 of a-Si: H is determined on the basis of the absorption factor of the a-Si:H so that light having a wavelength range corresponding to a camera used for imaging can be absorbed. The thickness of the layer 4 is preferably 0.1 to 1 μm, and more preferably 0.2 to 0.8 μm. When this layer 4 has an excessively large thickness, the number of photo-excited carriers trapped in the layer of a-Si: H while travelling therein increases. After the light is cut off, the trapped carriers will be liberated again, resulting in the increasing of lag. The thickness of the amorphous chalcogenide layer 5 is preferably about 1 to 10 μm. When a fast photo-response is required, the layer 5 is advantageously as thick as possible in the above range, because the overall electrostatic capacity of the photoelectronic conversion part is correspondingly decreased. Further, the layer 5 should be at least 1 μm thick in order to sufficiently absorb soft X-rays.

When light or an optical signal is applied to the glass substrate 1 of the photoelectronic conversion part of the image pickup tube according to the present invention, the optical signal is almost entirely absorbed in the a-Si: H layer 4 and is converted into photocarriers. In the image pickup tube, a voltage is applied in a direction which causes flow of holes from the transparent electrode 2 toward the electron beam scanning side. Therefore, among the photocarriers produced in the a-Si: H layer 4 electrons flow toward the transparent electrode 2 through the a-Si: H layer 4 having a high $\mu\tau$ product of electron mobility, while holes flow toward the electron beam scanning side through the amorphous selenium layer 5 having a high $\mu\tau$ product of hole.

Figure 3:
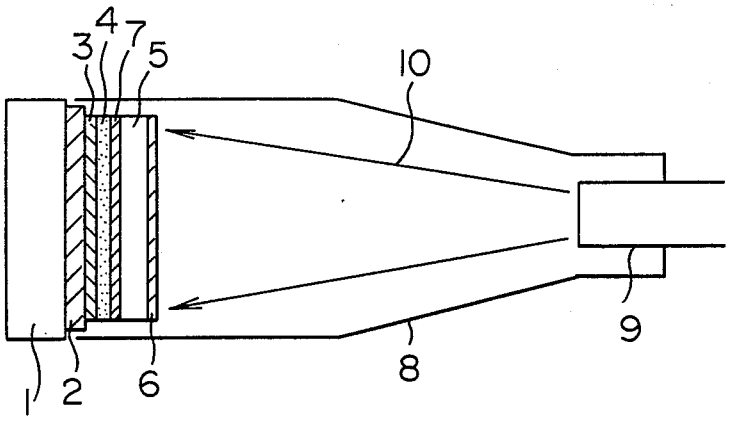
FIG. 3 is a schematic sectional view of the image pickup tube provided with the modification shown in FIG. 2.

FIG. 3 is a schematic sectional view of the image pickup tube described above. The reference numeral 1 designates the target substrate according to the present invention. The tube has an envelope 8 and an electron gun, and the reference numeral 10 indicates schematically an electron beam. The detail of the target will be described later.

Because of the unique structure of the photo-electronic conversion part of the image pickup tube described above, an incident optical signal is very efficiently converted into an electrical signal by utilization of the high photoelectronic conversion efficiency of the a-Si: layer 4. Therefore, the image pickup tube operates with a high sensitivity, and its operating characteristics are not degraded in spite of a long time of use since radiation generated in the electron gun 9 is absorbed by the amorphous selenium layer 5. In the image pickup tube, holes generated in response to an optical input signal must be kept stored during the period of time of scanning with the electron beam. In the present invention, the charge pattern provided by the optical signal is stored though the amorphous selenium layer 5 having a high electrical resistance. Therefore, undesirable diffusion of the charge pattern hardly occurs, and a picture is obtained with a high resolution. Also, since the electrical susceptibility of the amorphous selenium is smaller than that of the a-Si: H, the electrostatic capacity of the photoconductive film 4 can be made smaller than when the a-Si: H is singly used, and this is advantageous when a fast photo-response is desired.

As described above, it is the essential requirement of the present invention that a photoelectronic conversion part of an image pickup tube has a multilayered structure provided by laminating a layer 5 of an amorphous chalcogenide on a photoconductive layer 4 of a-Si: H. In order to further enhance the effects of the present invention, a III-group element or a V-group element in an amount of about 0.5 to several-hundred ppm may be added to the photoconductive a-Si: H layer 4 thereby improving the mobility of carriers, or arsenic acting to suppress crystallization of selenium may be added in an amount of several percent by weight to the amorphous selenium layer 5. Such modifications are also included in the scope of the present invention.

Figure 2:
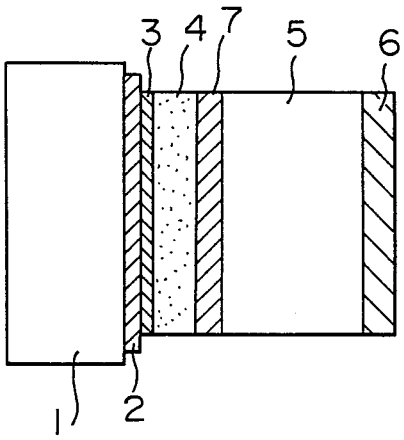
FIG. 2 is a schematic sectional view of a modification which includes an additionally provided intermediate layer.

The present invention becomes more effective when an intermediate layer 7 modulating an energy band structure or an internal field strength is interposed between the a-Si: H photoconductive layer 4 and the amorphous selenium layer 5 so as to ensure more smooth transfer of photocarriers from the a-Si: H photoconductive layer 4 to the amorphous selenium layer 5. FIG. 2 shows the structure of the photoelectronic conversion part including the intermediate layer 7.

When the intermediate layer 7 is formed of a material such as a tetrahedral amorphous material, the energy band structure can be changed by mixing, for example, germanium, carbon, tin or nitrogen in silicon thereby changing the composition. On the other hand, when the intermediate layer 7 is formed of a material such as amorphous selenium, addition of, for example, bismuth, cadmium, bismuth chalcogenide, cadmium chalcogenide, tellurium or tin to the amorphous selenium is effective for changing the energy band structure.

The internal field strength in the hole layer can be changed by adding to the tetrahedral amorphous material a very small amount of a III-group or V-group element which can modify the conductivity type in the vicinity of the interface. On the other hand, when the intermediate layer 7 is formed of a material such as amorphous selenium, it is effective to add an impurity which forms negative space charges, such as arsenic, germanium, antimony, indium, gallium or their chalcogenide, sulfur, chlorine, iodine, bromine, copper oxide, indium oxide, selenium oxide, vanadium pentoxide, molybdenum oxide, tungsten oxide, gallium fluoride or indium fluoride.

In order to make the embodiments of the present invention more clear, specific examples are described below, although the present invention should not be limited to those examples but various modification and variation can be made.

EXAMPLE 1

An example of the present invention will be described with reference to FIG. 1 which is a schematic sectional view of a target of an image pickup tube.

A transparent, electrical conductive film 2 of tin oxide is deposited on a glass substrate 1 by a method well known in the art. This transparent conductive film 2 may be that usually deposited on a substrate of a conversion part of a convertional image pickup tube.

Then, a film 3 of silicon oxide about 100 Å thick acting as a hole blocking layer and a photoconductive film 4 of a-Si: H containing 5 ppm of boron and about 0.1 to 1.0 μm thick are deposited in the above order on the glass substrate 1 having the tin oxide layer 2 deposited thereon in the manner described above. The silicon oxide film 3 may be deposited by a reactive sputtering method well known in the art, and the a-Si: H film 4 may be deposited by a well-known method of decomposing and polymerizing a gaseous material such as monosilane or disilane by means of plasma discharge. Heat or light may be used in lieu of the plasma discharge.

Then, a layer 5 of amorphous selenium containing 2% by weight of arsenic and about 6 μm thick is deposited on the photoconductive a-Si: H film 4 in an evaporation apparatus, and a layer 6 of antimony trisulfide about 500 Å thick is deposited on the amorphous selenium layer 5 while introducing an inert gas into the evaporation apparatus.

The photoelectronic conversion part formed in the manner described above is incorporated in a pickup-tube glass envelope having an electron gun 9 assembled therein to complete an image pickup tube.

The image pickup tube thus completed was operated by applying a voltage of +200 volts to the transparent electrode 2 relative to the cathode of the electron gun 9. The sensitivity was equivalent to an image pickup tube including a photoconductive a-Si: H film about 4 μm thick in its photoelectronic conversion part, and degraded operating characteristics such as a reduction of the sensitivity and an increase in the dark current were not observed even when the image pickup tube was continuously operated for a period of time of 10,000 hours.

EXAMPLE 2

This Example has also a structure as shown in FIG. 1. As in the case of the Example 1, a transparent electrode 2, a hole blocking layer 3 of silicon oxide, and a photoconductive layer 4 of a-Si: H are deposited in the above order on a glass substrate 1. Then, a film of amorphous selenium containing 20% by weight of arsenic and about 300 Å thick is deposited on the layer 4 as an intermediate layer 7, and a layer 5 of amorphous selenium containing 2% by weight of arsenic and about 4 μm thick is deposited on the intermediate layer 7. Then, a layer 6 of porous antimony trisulfide about 600 Å thick is deposited on the layer 5.

By use of such a structure, an applied voltage of about 100 volts was sufficient for fully achieving the required sensitivity of the image pickup tube, and the image pickup tube could stably operate with operating characteristics similar to those of the Example 1.

Figure 4:
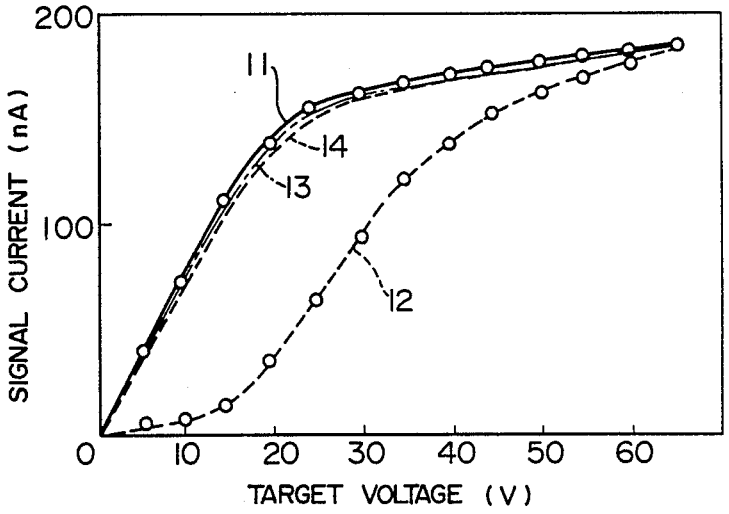
FIG. 4 is a graph showing the results of comparison of changes in the operating characteristics of a prior art image pickup tube having an a-Si: H layer only in its photoelectronic conversion part and an image pickup tube having an amorphous selenium layer combined with the a-Si: H layer in its photoelectronic conversion part according to the present invention when these tubes are continuously operated.

FIG. 4 shows the relation between the target voltage and the signal current when the scanning electron beam is accelerated at a voltage as high as 800 volts. The curves 11 and 12 indicate the relation between the target voltage and the signal current of an prior art image pickup tube in which its target includes an a-Si: H layer only and does not include the amorphous selenium layer provided according to the present invention. The curve 11 represents the above relation at the beginning of the operation of the image pickup tube, while the curve 12 represents the above relation after continuous operation of the tube for 100 hours. In contrast, the curves 13 and 14 indicate the relation between the target voltage and the signal current in the case of an image pickup tube to which the present invention is applied. Similarly, the curve 13 represents the above relation at the beginning of the operation of the image pickup tube, while the curve 14 represents the above relation after continuous operation of the tube for 100 hours. It will be seen in FIG. 4 that the image pickup tube to which the present invention is applied can operate for a long period of time without appreciable degradation of its operating characteristics.

EXAMPLE 3

This Example has a structure in which an intermediate layer is additionally provided in its photo-electric conversion part as shown in FIG. 2.

As in the case of the Example 1, a transparent electrode 2, a hole blocking layer 3, and a photoconductive a-Si: H layer 4 are deposited in the above order on a glass substrate 1. Then, as an intermediate layer 7, a film of a-Si: H containing 5 ppm of boron as its additive and about 200 Å thick, and a film of a-Si: H containing 100 ppm of phosphorus as its additive and about 50 Å thick are laminated in the above order on the layer 4. Then, a layer 5 of amorphous selenium containing 2% by weight of arsenic and about 6 μm thick is deposited on the intermediate layer 7, and finally a beam landing layer 6 of antimony trisulfide is deposited on the layer 5.

In such an image pickup tube, an applied voltage of about 80 volts was sufficient for fully activity the required sensitivity, and stable operating characteristics similar to those of the Example 1 were obtained.

EXAMPLE 4

As in the case of the Example 1, a transparent electrode 2, a hole blocking layer 3, and a photoconductive a-Si: H layer 4 are deposited in the above order on a glass substrate 1. Then, as an intermediate layer 7, a film of amorphous selenium containing 30% by weight of tellurium and about 200 Å thick, and a film of amorphous selenium containing arsenic and about 500 Å thick are laminated in the above order on the layer 4. In the latter film, its composition distribution is such that the concentration of arsenic decreases gradually from 20% to 2% in the direction of deposition of the film. A layer 5 of amorphous selenium containing 2% by weight of arsenic and about 6 μm thick is deposited on the intermediate layer 7, and finally beam landing layer 6 of antimony trisulfide is formed on the layer 6.

In such an image pickup tube, an applied voltage of about 50 volts was sufficient for fully achieving the required sensitivity, and stable operating characteristics similar to those of the Example 1 were obtained.

We claim:

1. A target of an image pickup tube comprising: a light-transmitting substrate; a transparent conductive layer on said substrate; a photoconductive layer on said conductive layer having a first amorphous layer for converting incident light into photo carriers and consisting essentially of silicon, and a second amorphous layer consisting essentially of selenium, wherein said first amorphous layer is disposed on a light receiving side of said photoconductive layer; and a blocking layer for preventing injection of carriers from said transparent conductive layer into said photoconductive layer.

2. A target of an image pickup tube according to claim 1, further comprising an intermediate layer interposed between said first amorphous layer consisting essentially of silicon and said second amorphous layer consisting essentially of selenium, said intermediate layer having an energy bandgap or a space charge intensity different from those of said amorphous layers.

3. A target of an image pickup tube according to claim 2, wherein said intermediate layer is formed by an amorphous layer consisting essentially of silicon and containing another element added thereto or an amorphous layer consisting essentially of selenium and containing another material added thereto.

4. A target of an image pickup tube according to claim 3, wherein at least one element selected from the group consisting of germanium, carbon, nitrogen and tin acting to change the energy bandgap and the group consisting of III-group elements and V-group elements acting to change the space charge intensity is added to said first amorphous layer consisting essentially of silicon and to said intermediate layer.

5. A target of an image pickup tube according to claim 3, wherein at least one material selected from the group consisting of bismuth, cadmium, bismuth chalcogenide, cadmium chalcogenide, tellurium and tin acting to change the energy bandgap and the group consisting of arsenic, germanium, antimony, indium, gallium, arsenic chalcogenide, germanium chalcogenide, antimony chalcogenide, indium chalcogenide, gallium chalcogenide, sulfur, chlorine, iodine, bromine, copper oxide, indium oxide, selenium oxide, vanadium pentoxide, molybdenum oxide, tungsten oxide, gallium fluoride and indium fluoride acting to change the space charge intensity is added to said second amorphous layer consisting essentially of selenium and to said intermediate layer.

6. A target of an image pickup tube according to claim 1, wherein said first amorphous layer consisting essentially of silicon has a thickness in the range of from 0.1 μm to 1 μm and said second amorphous layer consisting essentially of selenium has a thickness in the range of from 1 μm to 10 μm.

7. A target of an image pickup tube according to claim 2, wherein said intermediate layer is formed by an amorphous layer consisting essentially of silicon and containing another element added thereto.

8. A target of an image pickup tube according to claim 2, wherein said intermediate layer is formed by an amorphous layer consisting essentially of selenium and containing another material added thereto.

9. A target of an image pickup tube according to claim 2, wherein said intermediate layer is formed by an amorphous layer consisting essentially of silicon and containing another element added thereto and an amorphous layer consisting essentially of selenium and containing another material added thereto.

10. A target of an image pickup tube comprising a light-transmitting substrate providing a light-receiving side of said target, a transparent conductive layer of a metal oxide or of an evaporated metal adjacent to the substrate; a hole-blocking layer comprised of a-Si:H doped with phosphorus, an amorphous silicon nitride, or silicon oxide adjacent to the transparent conductive layer; a photoconductive layer for converting incident light into photo carriers and consisting essentially of amorphous silicon or a-Si:H arranged adjacent to the hole-blocking layer; a layer of an amorphous chalcogenide consisting essentially of selenium adjacent to the photoconductive layer; and a layer for ensuring smooth landing of an electron beam arranged adjacent to the layer of amorphous chalcogenide.

11. A target of an image pickup tube according to claim 10, wherein said transparent conductive layer comprises tin oxide or indium-tin oxide; the photoconductive layer consists essentially of a-Si:H; and the layer for ensuring smooth landing of an electron beam comprises antimony trisulfide.

12. A target of an image pickup tube comprising:

a light-transmitting substrate;

a transparent conductive layer on said substrate;

a photoconductive layer having a first amorphous layer for converting incident light into photo carriers and consisting essentially of silicon, and a second amorphous layer consisting essentially of selenium, wherein said first amorphous layer is disposed on a light receiving side of said photoconductive layer; and a blocking layer for preventing injection of carriers from said transparent conductive layer into said photoconductive layer.

* * * * *

UNITED STATES PATENT AND TRADEMARK OFFICE

CERTIFICATE OF CORRECTION

PATENT NO. : 4,900,975

DATED : February 13, 1990

INVENTOR(S) : SHIMOMOTO, et al

It is certified that error appears in the above-identified patent and that said Letters Patent is hereby corrected as shown below:

Column 7, line 31, (claim 4, line 8) delete "and to" and insert --to form--.

Column 7, line 46, (claim 5, line 14), delete "and to" and insert --to form--.

Signed and Sealed this

Tenth Day of January, 1995

*Attest:*

*Attesting Officer*

Bruce Lehman

BRUCE LEHMAN

*Commissioner of Patents and Trademarks*